US011261765B1

(12) United States Patent
Plumeau et al.

(10) Patent No.: US 11,261,765 B1
(45) Date of Patent: Mar. 1, 2022

(54) CONTROL VALVE ASSEMBLY OF A VARIABLE CAM TIMING PHASER

(71) Applicant: BorgWarner Inc., Auburn Hills, MI (US)

(72) Inventors: Joshua D. Plumeau, Groton, NY (US); Anand Barve, Lansing, NY (US)

(73) Assignee: BorgWamer Inc., Auburn Hills, MI (US)

( * ) Notice: Subject to any disclaimer, the term of this patent is extended or adjusted under 35 U.S.C. 154(b) by 0 days.

(21) Appl. No.: 17/002,257

(22) Filed: Aug. 25, 2020

(51) Int. Cl.
*F01L 1/344* (2006.01)
*F01L 1/047* (2006.01)

(52) U.S. Cl.
CPC ..... *F01L 1/3442* (2013.01); *F01L 1/047* (2013.01); *F01L 2001/3443* (2013.01); *F01L 2001/34433* (2013.01)

(58) Field of Classification Search
CPC ..... F01L 1/3442; F01L 1/047; F01L 2001/34433; F01L 2001/34426; F01L 2001/3443; F01L 1/344; F01L 2001/34423
USPC ..... 123/90.17, 90.15, 90.12
See application file for complete search history.

(56) References Cited

U.S. PATENT DOCUMENTS 2,673,062 A * 3/1954 Cornelius ..... F16K 15/026 137/540
4,552,311 A 11/1985 Casey
5,592,972 A * 1/1997 Niethammer ..... F15B 13/0402 137/625.65
6,289,921 B1 * 9/2001 Neuhaus ..... F15B 13/044 137/454.5
6,481,401 B1 * 11/2002 Schafer ..... F01L 1/3442 123/90.12

(Continued)

FOREIGN PATENT DOCUMENTS

DE 102007023617 A1 11/2008
DE 102011080264 A1 * 2/2013 ..... F16B 37/00

(Continued)

OTHER PUBLICATIONS

DE-102013203951 English Language Machine Translation, Nov. 2013.*

(Continued)

*Primary Examiner* — Patrick Hamo
*Assistant Examiner* — Wesley G Harris
(74) *Attorney, Agent, or Firm* — Howard & Howard Attorneys PLLC

(57) ABSTRACT

A control valve assembly of a variable cam timing phaser of a variable cam timing system, with the variable cam timing phaser including a housing and a rotor, and with the variable cam timing system including a camshaft, includes a valve housing extending along an axis. The valve housing includes a threaded portion adapted to engage the camshaft, and a body portion spaced axially from the threaded portion. The body portion defines a body interior. The control valve assembly also includes a piston disposed in the body interior and moveable along the axis between a first position and a second position. The control valve assembly further includes a cap removably coupled to the body portion of the valve housing. The cap includes a torque driving element configured to be received by a tool for transmitting torque from the tool for fixing the cap to the body portion.

21 Claims, 5 Drawing Sheets

(56) References Cited

U.S. PATENT DOCUMENTS

| | | | | |
|---|---|---|---|---|
| 7,013,854 | B1 * | 3/2006 | Heintzen | F01L 1/3442 123/90.15 |
| 8,893,676 | B2 * | 11/2014 | Hoppe | F01L 1/344 123/90.17 |
| 8,899,198 | B2 * | 12/2014 | Hoppe | F01L 1/344 123/90.17 |
| 9,016,663 | B2 | 4/2015 | Moreno et al. | |
| 9,695,716 | B2 | 7/2017 | Smith et al. | |
| 10,151,222 | B2 | 12/2018 | Burke et al. | |
| 2006/0011245 | A1 | 1/2006 | Suzuki et al. | |
| 2009/0145386 | A1 * | 6/2009 | Ushida | F01L 1/3442 123/90.17 |
| 2010/0084019 | A1 * | 4/2010 | Burke | F01L 1/3442 137/1 |
| 2011/0114047 | A1 * | 5/2011 | Hohmann | F01L 1/3442 123/90.15 |
| 2012/0145100 | A1 * | 6/2012 | Meinig | F01L 1/46 123/90.15 |
| 2014/0361206 | A1 | 12/2014 | Holmes et al. | |
| 2019/0244738 | A1 | 8/2019 | Klenk et al. | |
| 2019/0277167 | A1 | 9/2019 | Wing et al. | |
| 2020/0056518 | A1 | 2/2020 | Matsumoto et al. | |

FOREIGN PATENT DOCUMENTS

| | | | | |
|---|---|---|---|---|
| DE | 102013203951 | A1 * | 11/2013 | F01L 1/3442 |
| DE | 102012214762 | A1 * | 2/2014 | F16D 1/092 |
| DE | 102016220767 | A1 | 4/2018 | |
| DE | 102018130999 | A1 | 4/2020 | |
| EP | 1477636 | A2 | 11/2004 | |
| EP | 3529814 | A1 | 8/2019 | |
| JP | H0540852 | A | 2/1993 | |
| JP | 2017044109 | A | 3/2017 | |
| WO | 2018072916 | A1 | 4/2018 | |
| WO | 2020008626 | A1 | 1/2020 | |
| WO | 2020056256 | A1 | 3/2020 | |
| WO | 2020084763 | A1 | 4/2020 | |

OTHER PUBLICATIONS

English language abstract and machine-assisted English translation for DE 10 2007 023 617 extracted from espacenet.com database on Sep. 23, 2020, 70 pages.

Machine-assisted English language abstract for DE 10 2016 220 767 extracted from espacenet.com database on Sep. 23, 2020, 2 pages.

Machine-assisted English language abstract and machine-assisted English translation for DE 10 2018 130 999 extracted from espacenet.com database on Sep. 23, 2020, 15 pages.

English language abstract and machine-assisted English translation for EP 1 477 636 extracted from espacenet.com database on Sep. 23, 2020, 10 pages.

English language abstract and machine-assisted English translation for JPH 05-40852 extracted from espacenet.com database on Sep. 23, 2020, 9 pages.

English language abstract and machine-assisted English translation for JP 2017-044109 extracted from espacenet.com database on Sep. 23, 2020, 8 pages.

English language abstract for WO 2018/072916 extracted from espacenet.com database on Sep. 23, 2020, 1 page.

English language abstract and machine-assisted English translation for WO 2020/0086261 extracted from espacenet.com database on Sep. 23, 2020, 10 pages.

English language abstract and machine-assisted English translation for WO 2020/084763 extracted from espacenet.com database on Sep. 23, 2020, 17 pages.

* cited by examiner

CONTROL VALVE ASSEMBLY OF A VARIABLE CAM TIMING PHASER

BACKGROUND OF THE INVENTION

1. Field of the Invention

The present invention generally relates to a control valve assembly and, more specifically, to a control valve assembly of a variable cam timing phaser of a variable cam timing system.

2. Description of the Related Art

Conventional variable cam timing systems include a camshaft and a variable cam timing phaser, with the variable cam timing phaser including a housing having an arcuate outer wall disposed about an axis and defining a housing interior, a rotor at least partially disposed within the housing interior and moveable with respect to the housing, and a control valve assembly. Conventional control valve assemblies include a valve housing having a threaded portion engageable with the camshaft to fix the valve housing to the camshaft or to fix a variable cam timing phaser to the camshaft, and a piston disposed within the valve housing to control a flow of hydraulic fluid to cause rotation of the rotor with respect to the housing to adjust timing of the camshaft.

However, conventional control valve assemblies are limited in that they are only usable with a single variable cam timing system design. In other words, for each different variable cam timing system application, conventional control valve assemblies need to undergo a design change, in particular the valve housing and the threaded portion, such that the valve housing and threaded portion are engageable with the camshaft of the variable cam timing system. Even further, to ultimately secure the variable cam timing phaser to the camshaft, the valve housing is specifically designed for each different variable cam timing system such that a tool engages the valve housing to secure the variable cam timing assembly to the camshaft through engagement of the threaded portion of the valve housing to the camshaft.

As such, there remains a need to provide an improved control valve assembly of a variable cam timing phaser of a variable cam timing system.

SUMMARY OF THE INVENTION AND ADVANTAGES

A control valve assembly of a variable cam timing system, with the variable cam timing system including a camshaft, includes a valve housing extending along an axis. The valve housing includes a threaded portion adapted to engage the camshaft to fix the valve housing to the camshaft, and a body portion spaced axially from the threaded portion along the axis. The body portion is disposed about the axis and defines a body interior. The control valve assembly also includes a piston disposed in the body interior and moveable along the axis between a first position adjacent the threaded portion and a second position spaced axially from the first position away from the threaded portion. The control valve assembly further includes a cap removably coupled to the body portion of the valve housing. The cap includes a torque driving element configured to be received by a tool for transmitting torque from the tool for fixing the cap to the body portion.

Accordingly, the control valve assembly including a cap removably coupled to a body portion of a valve housing offers several advantages. First, having the cap removably coupled to the body portion of the valve housing allows insertion of various components of the control valve assembly, such as the piston, to be inserted into the body interior. Second, if components of the control valve assembly need to be accessed, the cap may be removed from the body portion of the valve housing. Third, having the cap removably coupled to the body portion of the valve housing allows different configurations and sizes of the cap to be used in the control valve assembly while optionally keeping the same valve housing design. Fourth, the torque driving element of the cap may be configured based on the tool design used for fixing the cap to the body portion.

A control valve assembly of a variable cam timing system, with the variable cam timing system including a camshaft, includes a valve housing extending along an axis. The valve housing includes a threaded portion adapted to engage the camshaft to fix the valve housing to the camshaft, and a body portion spaced axially from the threaded portion along the axis. The body portion is disposed about the axis and defines a body interior. The valve housing further includes a cap integral with the body portion and configured to be received by a tool for transmitting torque from the tool for fixing said valve housing to the camshaft. The control valve assembly also includes a piston disposed in the body interior and moveable along the axis between a first position adjacent the threaded portion and a second position spaced axially from the first position away from the threaded portion. The threaded portion of the valve housing is removably coupled to the body portion of the valve housing.

Accordingly, the control valve assembly including the threaded portion of the valve housing removably coupled to the body portion of the valve housing offers several advantages. First, having the threaded portion removably coupled to the body portion of the valve housing allows insertion of various components of the control valve assembly, such as the piston, to be inserted into the body interior. Second, if components of the control valve assembly need to be accessed, the threaded portion may be removed from the body portion of the valve housing. Third, having the threaded portion removably coupled to the body portion of the valve housing allows different configurations and sizes of the threaded portion to be used in the control valve assembly while optionally keeping the same valve housing design. For example, the threaded portion of the body portion may be customized based on the design of the camshaft.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
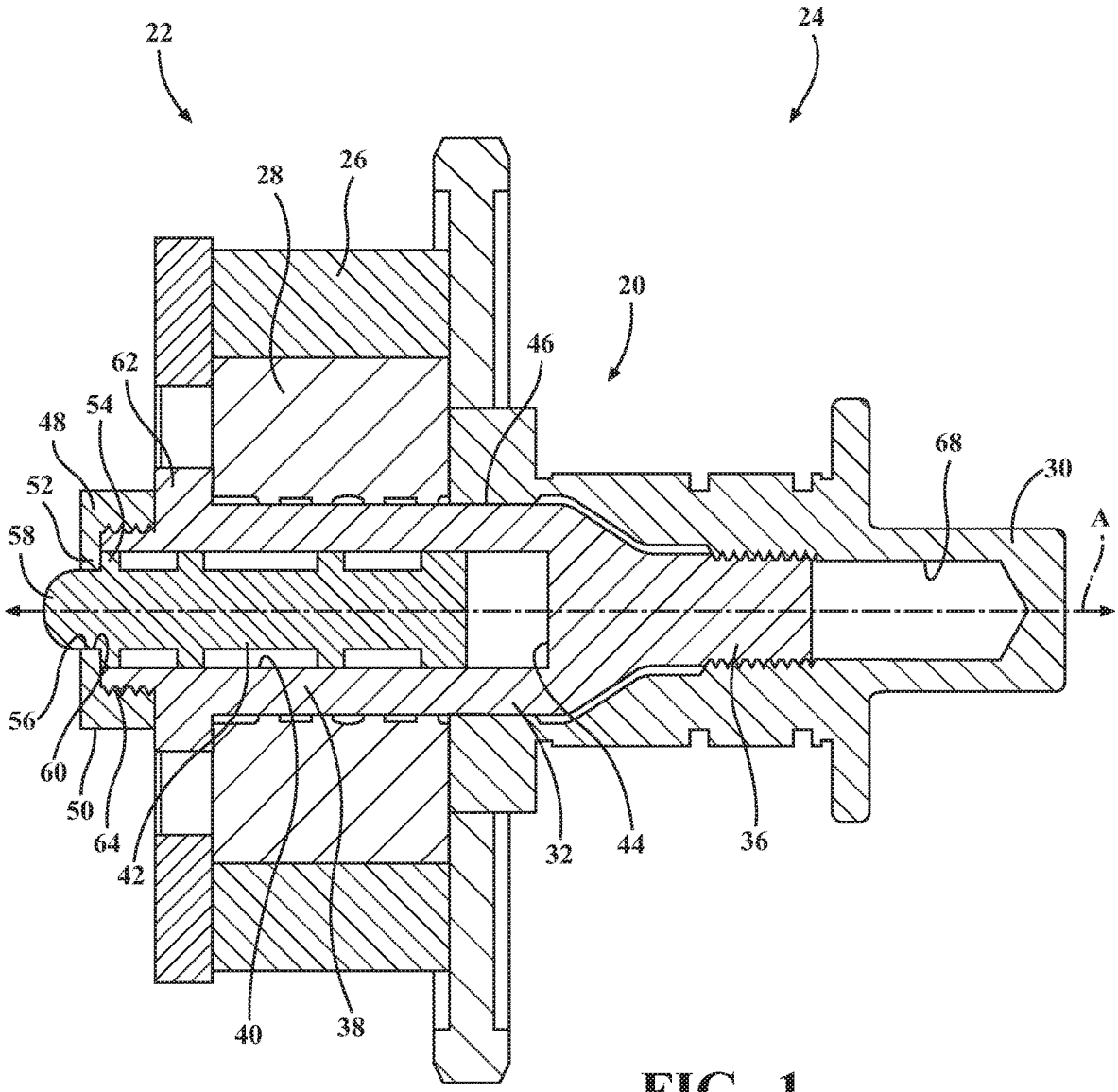
FIG. 1 is a cross-sectional view of a control valve assembly of a variable cam timing phaser of a variably cam timing system, with the variable cam timing system including a camshaft and the variable cam timing phaser, with the variable cam timing phaser including a housing, a rotor, and a control valve assembly, and with the control valve assembly including a valve housing including a body portion and a threaded portion, a piston disposed in a body interior of the body portion, and a cap removably coupled to the body portion of the valve housing.

With reference to the Figures, wherein like numerals indicate like parts throughout the several views, a control valve assembly 20 of a variable cam timing phaser 22 of a variable cam timing system 24 is shown in FIG. 1. The variable cam timing phaser 22 includes a housing 26 and a rotor 28. The variable cam timing system 24 includes a camshaft 30.

The control valve assembly 20 includes a valve housing 32 extending along an axis A. The valve housing 32 includes a threaded portion 36 adapted to engage the camshaft 30 to fix the valve housing 32 to the camshaft 30. It is to be appreciated that the valve housing 32 including the threaded portion 36 adapted to engage the camshaft 30 to fix the valve housing 32 to the camshaft 30 may also be, or alternatively be, adapted to fix a variable cam timing phaser to the camshaft 30, as described in further detail below. The valve housing 32 also includes a body portion 38 spaced axially from the threaded portion 36 along the axis A. The body portion 38 is disposed about the axis A and defines a body interior 40. In some embodiments, the threaded portion 36 and the body portion 38 collectively define the body interior 40. The control valve assembly 20 further includes a piston 42 disposed in the body interior 40 and moveable along the axis A between a first position adjacent the threaded portion 36 and a second position spaced axially from the first position away from the threaded portion 36. The threaded portion 36 may include a stop surface 44 facing the piston 42 to prevent axial movement of the piston 42 beyond the first position away from the second position. Although not shown in the FIGS., the threaded portion 36 may be formed on an outer body surface 46, which shortens the overall length of the valve housing 32.

The control valve assembly 20 also includes a cap 48 removably coupled to the body portion 38 of the valve housing 32. Typically, the cap 48 and the body portion 38 collectively define the body interior 40. In some embodiments, the cap 48, the body portion 38, and the threaded portion 36 collectively define the body interior 40, as shown in FIGS. 1, 3, and 5-7. The cap 48 captures the internal components of the control valve assembly 20, such as the piston 42.

Having the cap 48 removably coupled to the body portion 38 of the valve housing 32 allows insertion of various components of the control valve assembly 20, such as the piston 42, to be inserted into the body interior 40. Additionally, if components of the control valve assembly 20 need to be accessed, the cap 48 may be removed (i.e., decoupled) from the body portion 38 of the valve housing 32. Furthermore, having the cap 48 removably coupled to the body portion 38 of the valve housing 32 allows different configurations and sizes of the cap 48 to be used in the control valve assembly 20 while optionally keeping the same valve housing 32 design.

As shown in FIGS. 1-7, the cap 48 includes a torque driving element 50 configured to be received by a tool for transmitting torque from the tool for fixing the cap 48 to the body portion 38. The torque driving element 50 transmitting torque from the tool drives the valve housing 32 into engagement with the camshaft 30. Fixing the cap 48 to the body portion 38 ultimately fixes the valve housing 32 to the camshaft 30 and/or the variable cam timing phaser 22 to the camshaft 30. In other words, the cap 48 drives the valve housing 32 into engagement with camshaft 30. The torque driving element 50 of the cap 48 may be configured based on the tool design used for fixing the cap 48 to the body portion 38. In other words, because the cap 48 is removably coupled to the body portion 38 of the valve housing 32, the torque driving element 50 may be specifically designed based on the tool being used for fixing the cap 48 to the body portion 38. In essence, only the cap 48 and, specifically, the torque driving element 50 needs to be designed based on the tool used for fixing the cap 48 to the body portion 38 of the valve housing 32, rather than redesigning the valve housing 32 when the valve housing 32 has a torque driving element, which gives greater modularity of the control valve assembly 20. In one embodiment, the cap 48 is threadingly coupled to the body portion 38 of the valve housing 32. In other embodiments, the cap 48 may be splined to the body portion 38 of the valve housing 32.

The torque driving element 50 may extend away from the body portion 38 and the threaded portion 36 with respect to the axis A. Having the torque driving element 50 extending away from the body portion 38 and the threaded portion 36 with respect to the axis A provides the tool easier access to the torque driving element 50. It is to be appreciated that the torque driving element 50 may be recessed within the cap 48 and configured to receive a tool for transmitting torque from the tool for fixing the cap 48 to the body portion 38.

In one embodiment, the torque driving element 50 has a hexagonal configuration, as is commonly referred to as a hex nut. When the torque driving element 50 has a hexagonal configuration, the torque driving element 50 configured to be received by a tool that also has a hexagonal configuration to fix the cap 48 to the body portion 38. As described above, having the cap 48 being removably coupled to the body portion 38 of the valve housing 32 allows different configurations and sizes of the cap 48 to be used in the control valve assembly 20. This is advantageous because the cap 48 may be designed based on design parameters of the tool, and the design of the remaining control valve assembly components, and in particular the valve housing 32, do not need to be redesigned for different applications of the control valve assembly 20.

As shown in FIGS. 1, 3, and 5-7, the cap 48 may include a cap retention flange 52 extending toward the axis A to retain the piston 42 within the body interior 40. For example, the piston 42 may be engageable with the cap retention flange 52 when in the second position to prevent axial movement of the piston 42 beyond the second position away from the first position. Because the cap retention flange 52 is engageable by the piston 42, the cap 48 may set the stroke length of the piston 42. The piston 42 may include a piston flange 54 extending away from the axis A and configured to engage the cap retention flange 52 when the piston 42 is in the second position. When the cap 48 includes the cap retention flange 52, the control valve assembly 20 is free of a snap ring for preventing axial movement of the piston beyond the second position. Having the cap retention flange 52 is more robust than having a traditional snap ring because the cap 48 is coupled to the body portion 38, such as through a threaded engagement, which is robust to handle repeated engagement from the piston 42.

With continued reference to FIGS. 1, 3, and 5-7, in one embodiment, the cap retention flange 52 defines a cap cavity 56 and the piston 42 includes a piston protrusion 58 extendable into the cap cavity 56 when the piston 42 is in the second position. The cap cavity 56 may be further defined as a cap hole 60 such that the piston protrusion 58 of the piston protrusion 58 extends beyond the cap 48 when in the second position. The cap hole 60, when present, allows a variable force solenoid (not shown, but may be included in the variable cam timing phaser 22) to engage the piston 42 for moving the piston 42 between the first and second positions.

Figure 2:
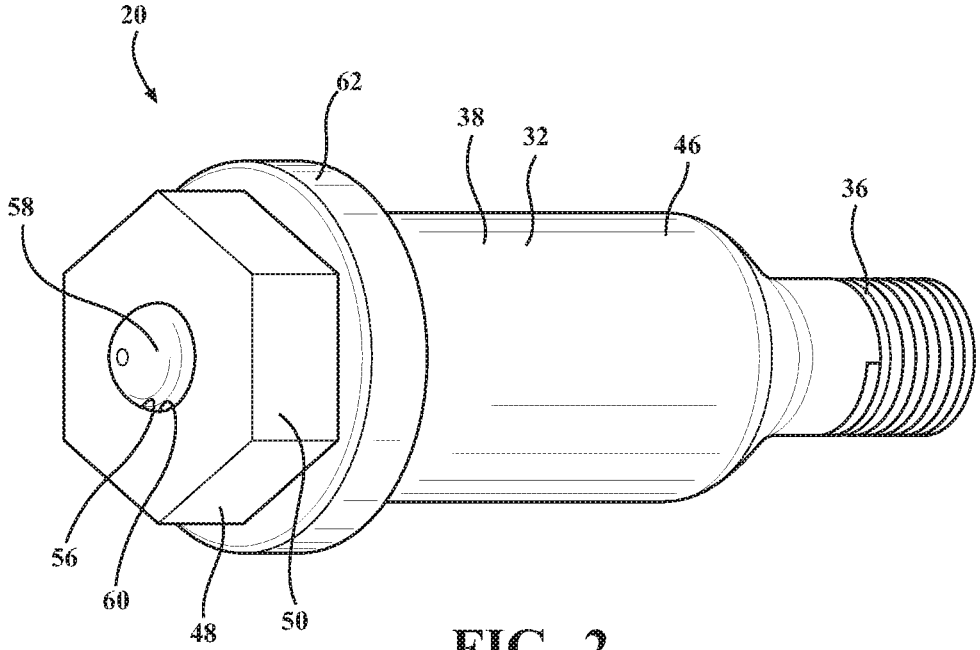
FIG. 2 is a perspective view of the control valve assembly of FIG. 1.
Figure 3:
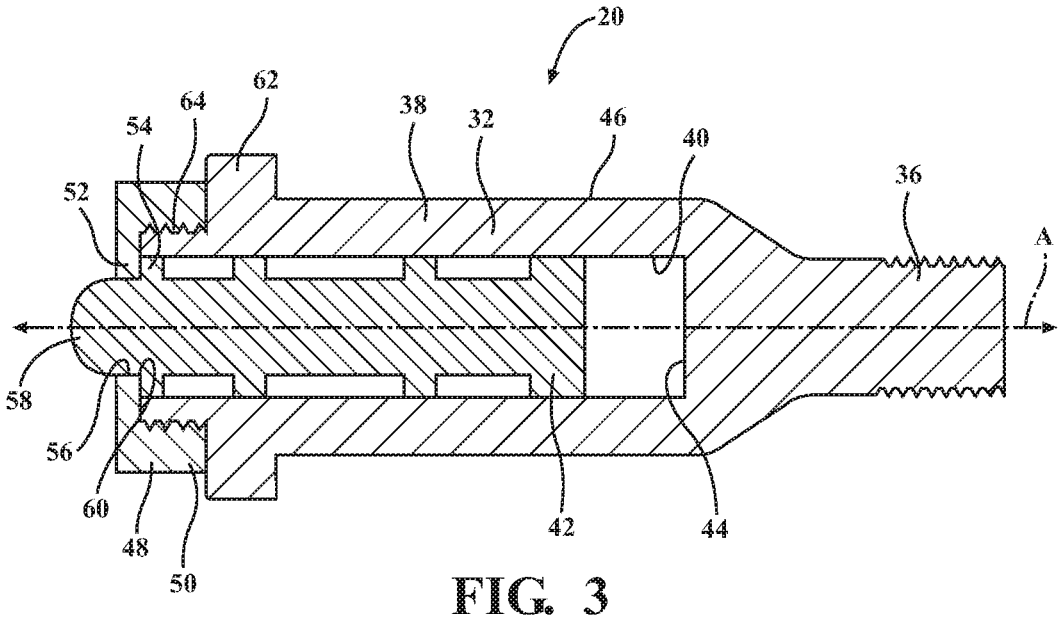
FIG. 3 is a cross-sectional view of the control valve assembly of FIG. 1.
Figure 4:
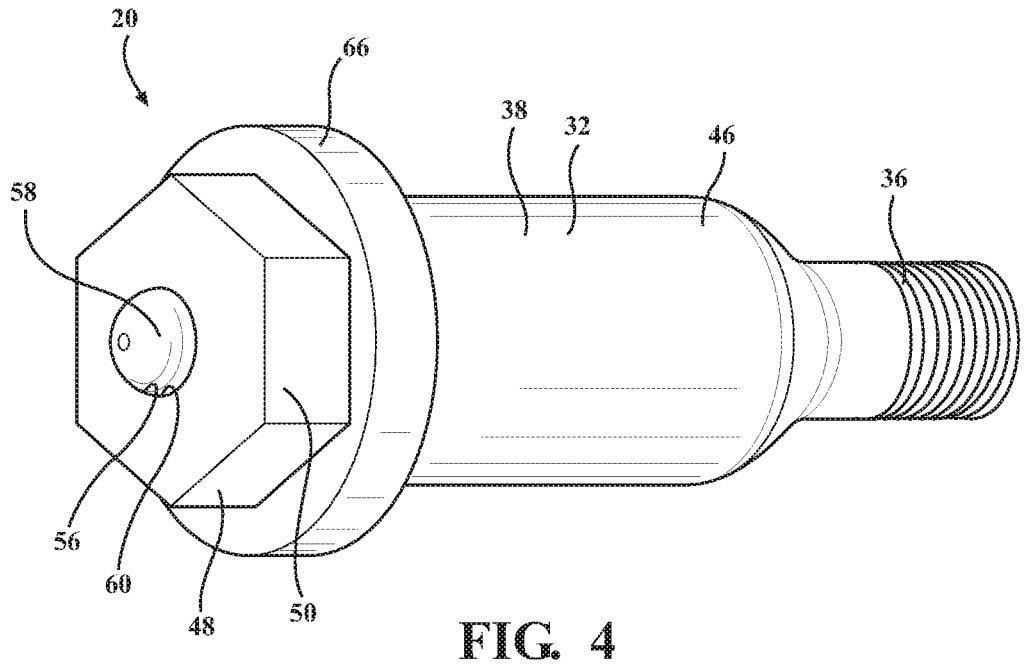
FIG. 4 is a perspective view of another embodiment of the control valve assembly.
Figure 5:
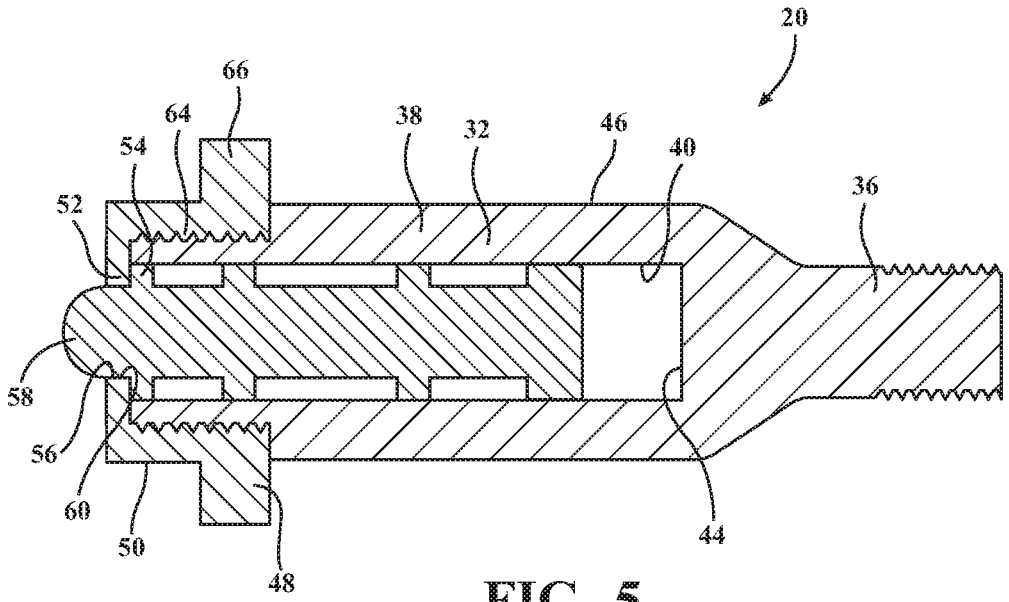
FIG. 5 is a cross-sectional view of the control valve assembly of FIG. 4.

The valve housing 32 may include an outer body flange 62 extending away from the axis A, as shown in FIGS. 1-3. Specifically, the body portion 38 of the valve housing 32 may include the outer body flange 62 extending away from the axis A. When present, the outer body flange 62 is adapted to engage the rotor 28 or another component, such as a center plate or sensor wheel, connected to the rotor 28 for axially securing the valve housing 32 to the camshaft 30 and/or the variable cam timing phaser 22 to the camshaft 30. Alternatively, as shown FIGS. 4-7, the cap 48 may include an outer cap flange 66 extending away from the axis A. When present, the outer cap flange 66 is adapted to engage the rotor 28 or a component connected to the rotor 28 for axially securing the valve housing 32 to the camshaft 30 and/or the variable cam timing phaser 22 to the camshaft. 30. When the cap 48 includes the outer cap flange 66, the outer cap flange 66 may be specifically designed based on the rotor 28 design. In other words, the cap 48 and the outer cap flange 66 provide modularity of the control valve assembly 20 as the cap 48 and the outer cap flange 66 design may be changed based on the requirements of the variable cam timing phaser 22, rather than redesigning the entire valve housing 32. The torque driving element 50 may extend away from the outer cap flange 66 and the threaded portion 36 with respect to the axis A. It is to be appreciated that the cap 48 shown in FIGS. 1-3 may also be used in the control valve assembly 20 shown in FIGS. 6 and 7.

The cap 48 may include a cap threaded portion 64 to engage the body portion 38 of the valve housing 32 to fix the cap 48 to the body portion 38. As shown in FIGS. 1, 3, and 5-7, the cap threaded portion 64 is on an inner diameter of the cap 48 facing the axis A. However, it is to be appreciated that the cap threaded portion 64 may be on an outer diameter of the cap 48.

The threaded portion 36 and the body portion 38 may be integral with one another, i.e., one-piece. In such embodiments, the valve housing 32 may be further defined as a centerbolt. Having the threaded portion 36 and the body portion 38 integral with one another allows for easier installation as the body portion 38 and the threaded portion 36 can be coupled to the camshaft 30 at the same time.

Figure 6:
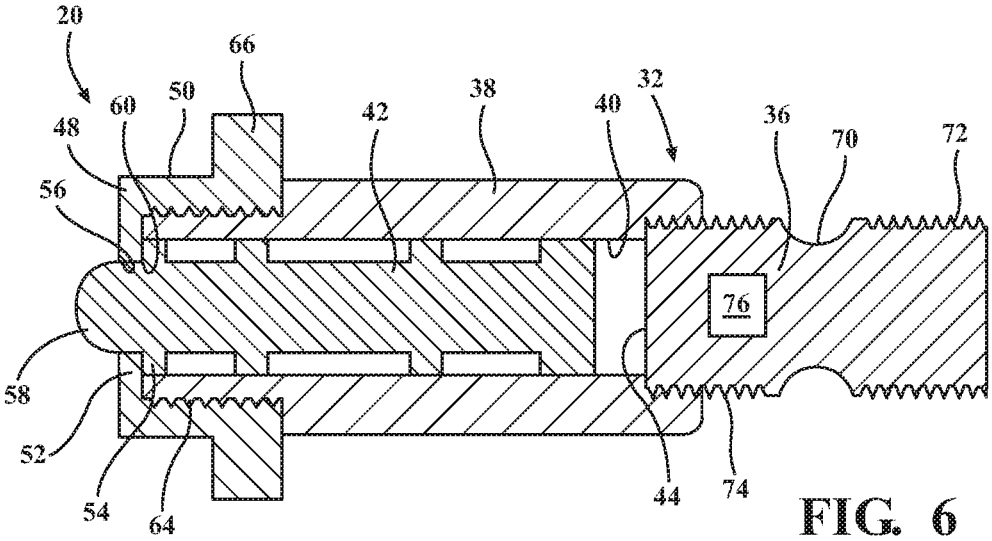
FIG. 6 is a cross-sectional view of another embodiment of the control valve assembly, with the threaded portion of valve housing being removably coupled to the body portion of the valve housing.
Figure 7:
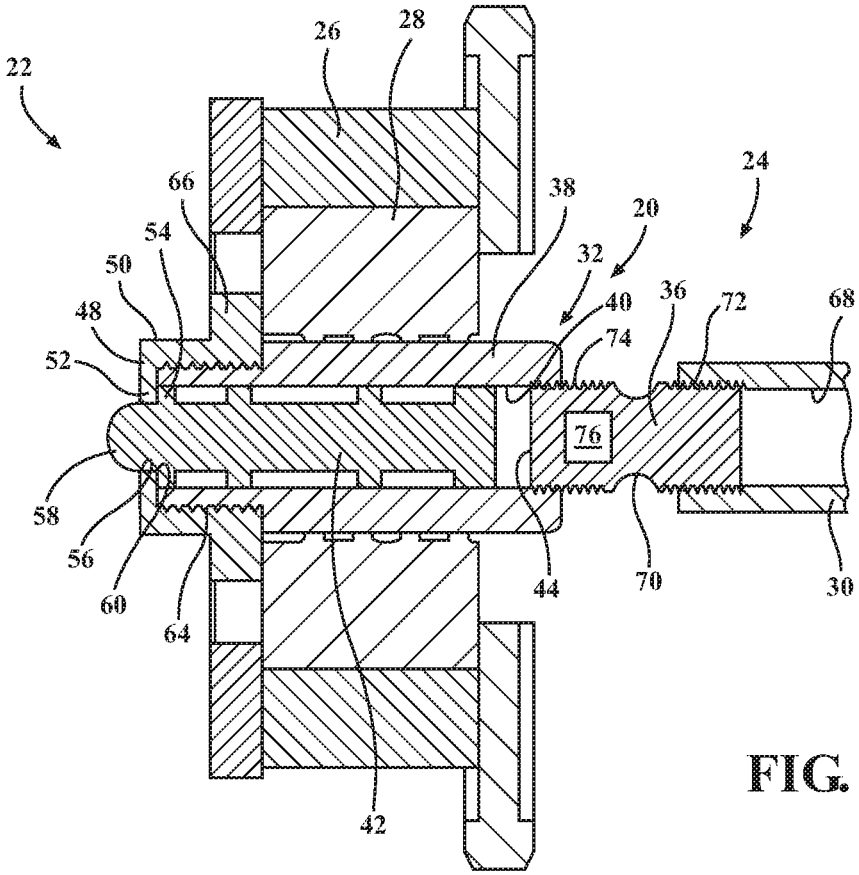
FIG. 7 is a cross-sectional view of the variable cam timing system and the variable cam timing phaser including the control valve assembly of FIG. 6.

In one embodiment, as shown in FIGS. 6 and 7, the threaded portion 36 of the valve housing 32 is removably coupled to the body portion 38 of the valve housing 32. Having the threaded portion 36 of the valve housing 32 removably coupled to the body portion 38 of the valve housing 32 offers several advantages. First, the same body portion 38 of the valve housing 32 may be used for different camshaft 30 designs. For example, when the threaded portion 36 is removably coupled to the body portion 38, the threaded portion 36 may be designed for each specific camshaft 30, rather than having to redesign the entire valve housing 32. Even with different camshaft 30 designs, the same body portion 38 of the valve housing 32 may be used because the dimensions of the threaded portion 36 (i.e., thread pitch, diameter, etc.) may be changed to allow the threaded portion to be coupled to the body portion 38 and the camshaft 30. Second, the threaded portion 36 may fluidly separate the body interior 40 from a camshaft interior 68 defined by the camshaft 30. In other words, the threaded portion 36 collectively defines the body interior 40 and the camshaft interior 68. Third, having the threaded portion 36 removably coupled to the body portion 38 of the valve housing 32 allows insertion of various components of the control valve assembly 20 from the threaded portion side of the valve housing 32, such as the piston 42, to be inserted into the body interior 40. Additionally, if components of the control valve assembly 20 need to be accessed, the threaded portion 36 may be removed (i.e., decoupled) from the body portion 38 of the valve housing 32. Fourth, having the threaded portion 36 removably coupled to the body portion 38 of the valve housing 32 gives greater modularity of the control valve assembly 20 as a whole, because when the design of the camshaft changes, only the threaded portion 36 needs to be redesigned to fix the variable cam timing phaser 22 to the camshaft 30. In embodiments where both the cap 48 and the threaded portion 36 are removably coupled to the body portion 38, various components of the control valve assembly 20, such as the piston 42, may be inserted from either side of the body portion 38, which allows a greater design flexibility. Furthermore, having the cap 48 and the threaded portion 36 removably coupled to the body portion 38 provides even greater modularity because the body portion 38 of the valve housing 32 may remain the same design, and only the cap 48 and the threaded portion 36 need to be redesigned based on the configuration of the tool and the camshaft 30, respectively.

With continued reference to FIGS. 6 and 7, the threaded portion 36 of the valve housing 32 may include a neck down portion 70 with respect to the axis A. Having the neck down portion 70 allows the threaded portion 36 of the valve housing 32 to control the amount of axial stretching of the threaded portion 36 to be robust against various noise factors during operation of the control valve assembly 20 as a result of various conditions, such as changing temperature, differing thermal expansion coefficients encountered by different components of the variable cam timing system 24, embedment loss over time for the clamped components, such as a rotor, sensor wheel, center plate, etc., of the variable cam timing system 24, etc. The neck down portion 70 may be concave with respect to the axis A or a different shape that reduces the cross section of the threaded portion 36, as shown in FIGS. 6 and 7.

The threaded portion 36 of the valve housing 32 may include a first engagement portion 72 adapted to engage the camshaft 30 to fix the valve housing 32 to the camshaft 30, and a second engagement portion 74 configured to engage the body portion 38 to fix the threaded portion 36 to the body portion 38. Typically, the first engagement portion 72 includes threads to threadingly engage the camshaft 30 to fix the threaded portion 36 to the camshaft 30 and the second engagement portion 74 typically includes threads to threadingly engage the body portion 38 of the valve housing 32. In such embodiments, the first engagement portion 72 may have a different thread pitch and size than the second engagement portion. For example, the first engagement portion 72 may have a smaller thread size and a different pitch than the second engagement portion 74. It is to be appreciated that the second engagement portion 74 may engage the body portion 38 through other suitable structures, such as locking tabs, to axially retain the threaded portion 36 with respect to the body portion 38.

The cap 48 may have a cap material and the valve housing 32 may have a housing material different from the cap material. For example, the cap material may be a grade of steel that has higher toughness and impact resistance as compared to the housing material because the tool contacts the cap 48. The housing material may also be steel and, as mentioned above, may be a grade of steel that has a lower toughness and impact resistance compared to the cap material.

In embodiments where the threaded portion 36 of the valve housing 32 is removably coupled to the body portion 38 of the valve housing 32, the threaded portion 36 of the valve housing 32 may have a threaded material and the body portion 38 may have a body material different from the threaded material. For example, the threaded material, for example, may be a grade of steel with higher ductility as compared to the housing material because the threaded material may stretch during operation of the variable cam timing system 24. The housing material may also be steel and, as mentioned above, and may be a grade of steel that has a lower ductility compared to the threaded material. Having the threaded material and the body material being different allows each of the threaded portion 36 and the body portion 38 to be designed specifically to meet the technical requirements of each of the threaded portion 36 portion and the body portion 38. Therefore, rather than having the threaded material and the body material being the same, the materials for the threaded portion 36 and the body portion 38 may reduce costs of the control valve assembly 20 all while meeting the technical requirements of each component.

The control valve assembly 20 may include a check valve 76. In one embodiment, the check valve 76 is disposed within the threaded portion 36 of the valve housing 32, as shown in FIGS. 6 and 7. Having the check valve 76 disposed within the threaded portion 36 of the valve housing 32, in particular when the threaded portion 36 is removably coupled to the body portion 38, allows further flexibility in packaging internal components and passages whereby the check valve 76 may be sub-assembled as part of the threaded portion 36. Additionally, the threaded portion 36 may be customized depending on the design requirements of each variable cam timing system. The control valve assembly 20 may include other components within the threaded portion 36, such as a filter.

Figure 8:
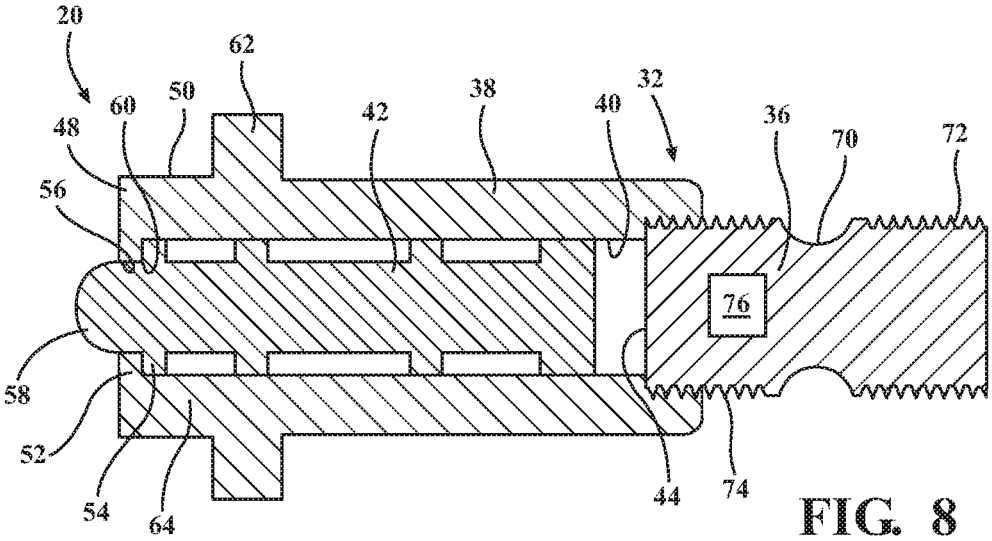
FIG. 8 is a cross-sectional view of another embodiment of the control valve assembly, with the cap and the valve body being integral with one another, and with the threaded portion of the valve housing removably coupled to the body portion of the valve housing.
Figure 9:
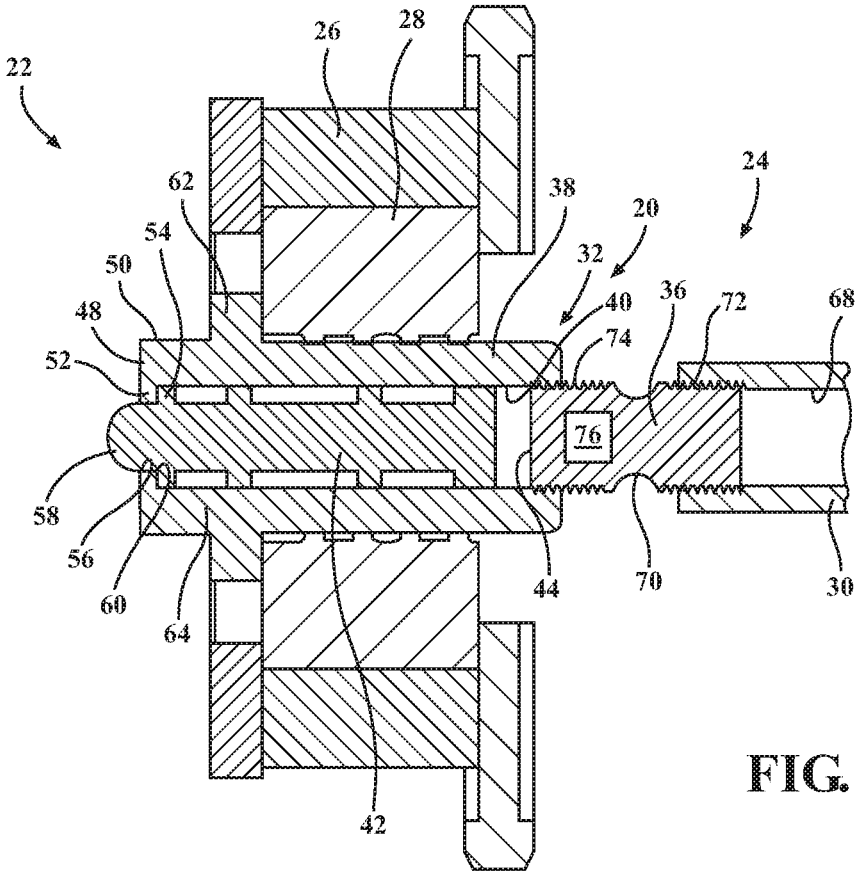
FIG. 9 is a cross-sectional view of the variable cam timing phaser including the control valve of FIG. 8.

As shown in FIGS. 8 and 9, the valve housing 32 includes the threaded portion 36 adapted to engage the camshaft 30 to fix the valve housing 32 to the camshaft 30. The valve housing 32 also includes the body portion 38 spaced axially from the threaded portion 36 along the axis A. The body portion 38 disposed about the axis A and defining the body interior 40. The valve housing 32 further includes the cap 48 integral with the body portion 38, i.e., one piece, and configured to be received by the tool for transmitting torque from the tool for fixing the valve housing 32 to the camshaft 30. The control valve assembly 20 includes the piston 42 disposed in the body interior 40 and moveable along the axis A between a first position adjacent the threaded portion 36 and a second position spaced axially from the first position away from the threaded portion 36. The threaded portion 36 of the valve housing 32 is removably coupled to the body portion 38 of the valve housing 32.

With continued reference to FIGS. 8 and 9, the first engagement portion 72 is adapted to engage the camshaft 30 to fix the valve housing 32 to the camshaft 30, and the second engagement portion 74 is configured to engage the body portion 38 to fix the threaded portion 36 to the body portion 38.

With continued reference to FIGS. 8 and 9, the control valve assembly 20 may include a check valve 76 disposed within the threaded portion 36 of the valve housing 32. Having the check valve 76 disposed within the threaded portion 36 of the valve housing 32 allows further flexibility in packaging internal components and passages whereby the check valve 76 may be sub-assembled as part of the threaded portion 36. Additionally, the threaded portion 36 may be customized depending on the design requirements of each variable cam timing system. The control valve assembly 20 may include other components within the threaded portion 36, such as a filter.

With continued reference to FIGS. 8 and 9, the threaded portion 36 of the valve housing 32 may include a neck down portion 70 with respect to the axis A. As described above, having the neck down portion 70 allows the threaded portion 36 of the valve housing 32 to control the amount of axial stretching of the threaded portion 36 to be robust against various noise factors during operation of the control valve assembly 20 as a result of various conditions, such as changing temperature, differing thermal expansion coefficients encountered by different components of the variable cam timing system 24, embedment loss over time for the clamped components, such as a rotor, sensor wheel, center plate, etc., of the variable cam timing system 24, etc. The neck down portion 70 may be concave with respect to the axis A or a different shape that reduces the cross section of the threaded portion 36.

The invention has been described in an illustrative manner, and it is to be understood that the terminology which has been used is intended to be in the nature of words of description rather than of limitation. Many modifications and variations of the present invention are possible in light of the above teachings, and the invention may be practiced otherwise than as specifically described.

What is claimed is:

1. A variable cam timing phaser of a variable cam timing system, with the variable cam timing system including a camshaft, said variable cam timing phaser comprising:

a housing having an arcuate outer wall disposed about an axis and defining a housing interior;

a rotor at least partially disposed within said housing interior and moveable with respect to said housing, with said rotor having a hub and a plurality of vanes extending from said hub away from said axis toward said arcuate outer wall; and a control valve assembly comprising, a valve housing extending along said axis, with said valve housing comprising, a threaded portion adapted to engage the camshaft for fixing said valve housing to the camshaft, and a body portion spaced axially from said threaded portion along said axis, and with said body portion disposed about said axis and defining a body interior;

a piston disposed in said body interior and moveable along said axis between a first position adjacent said threaded portion and a second position spaced axially from said first position away from said threaded portion, and a cap removably coupled to said body portion of said valve housing;

wherein said cap comprises a torque driving element configured to be received by a tool for transmitting torque from the tool for fixing said cap to said body portion; and wherein said cap is configured to drive said valve housing into engagement with the camshaft for fixing said valve housing, said rotor, and said housing to the camshaft.

2. The variable cam timing phaser as set forth in claim 1, wherein said body portion of said valve housing comprises an outer body flange extending away from said axis, wherein said outer body flange is engageable with said rotor or a component connected to said rotor for axially securing said valve housing with respect to said axis.

3. The variable cam timing phaser as set forth in claim 1, wherein said cap comprises an outer cap flange extending away from said axis, wherein said outer cap flange is engageable with said rotor or a component connected to said rotor for axially securing said valve housing with respect to said axis.

4. A variable cam timing system comprising said variable cam timing phaser as set forth in claim 1, wherein said variable cam timing system further comprises a camshaft.

5. The variable cam timing phaser as set forth in claim 1, wherein said body portion of said valve housing has an outer body surface facing away from said axis, wherein said cap has an inner cap surface facing said outer body surface, and wherein said inner cap surface is engaged with said outer body surface when said cap is fixed to said body portion.

6. The variable cam timing phaser as set forth in claim 1, wherein said torque driving element extends away from said body portion and said threaded portion with respect to said axis.

7. The variable cam timing phaser as set forth in claim 1, wherein said torque driving element has a hexagonal configuration.

8. The variable cam timing phaser as set forth in claim 1, wherein said cap comprises a cap retention flange extending toward said axis to retain said piston in said body interior.

9. The variable cam timing phaser as set forth in claim 1, wherein said threaded portion and said body portion are integral with one another.

10. The variable cam timing phaser as set forth in claim 9, wherein said valve housing is further defined as a centerbolt.

11. The variable cam timing phaser as set forth in claim 1, wherein said threaded portion of said valve housing is removably coupled to said body portion of said valve housing.

12. The variable cam timing phaser as set forth in claim 11, wherein said threaded portion of said valve housing comprises a first engagement portion adapted to engage the camshaft for fixing said valve housing to the camshaft, and a second engagement portion configured to engage said body portion for fixing said threaded portion to said body portion.

13. The variable cam timing phaser as set forth in claim 11, further comprising a check valve disposed within said threaded portion of said valve housing.

14. The variable cam timing phaser as set forth in claim 1, wherein said cap comprises a cap material and said valve housing comprises a housing material different from said cap material.

15. The variable cam timing phaser as set forth in claim 1, wherein said threaded portion of said valve housing is removably coupled to said body portion of said valve housing, and wherein said threaded portion of said valve housing comprises a threaded material and said body portion comprises a body material different from said threaded material.

16. The variable cam timing phaser as set forth in claim 1, wherein said threaded portion of said valve housing is removably coupled to said body portion of said valve housing, and wherein said threaded portion of said valve housing comprises a neck down portion with respect to said axis.

17. A variable cam timing phaser of a variable cam timing system, with the variable cam timing system including a camshaft, said variable cam timing phaser comprising:

a housing having an arcuate outer wall disposed about an axis and defining a housing interior;

a rotor at least partially disposed within said housing interior and moveable with respect to said housing, with said rotor having a hub and a plurality of vanes extending from said hub away from said axis toward said arcuate outer wall; and a control valve assembly comprising, a valve housing extending along said axis, with said valve housing comprising, a threaded portion adapted to engage the camshaft for fixing said valve housing to the camshaft, a body portion spaced axially from said threaded portion along said axis, and with said body portion disposed about said axis and defining a body interior, and a cap integral with said body portion and configured to be received by a tool for transmitting torque from the tool for fixing said valve housing to the camshaft, and a piston disposed in said body interior and moveable along said axis between a first position adjacent said threaded portion and a second position spaced axially from said first position away from said threaded portion;

wherein said threaded portion of said valve housing is removably coupled to said body portion of said valve housing;

wherein said threaded portion of said valve housing comprises a first engagement portion adapted to engage the camshaft for fixing said valve housing to the camshaft, and a second engagement portion configured to engage said body portion for fixing said threaded portion to said body portion; and wherein said second engagement portion includes threads to threadingly engage the body portion of the valve housing.

18. The variable cam timing phaser as set forth in claim 17, further comprising a check valve disposed within said threaded portion of said valve housing.

19. The variable cam timing phaser as set forth in claim 17, wherein said threaded portion of said valve housing comprises a neck down portion with respect to said axis.

20. The variable cam timing phaser as set forth in claim 17, wherein said valve housing is further defined as a centerbolt.

21. A variable cam timing system comprising said variable cam timing phaser as set forth in claim 17, wherein said variable cam timing system further comprises said camshaft.

* * * * *